US005698381A

United States Patent [19]

Wildman

[11] Patent Number: 5,698,381

[45] Date of Patent: Dec. 16, 1997

[54] PROCESSING SYSTEM FOR THE DEVELOPMENT OF PHOTOGRAPHIC MATERIALS

[75] Inventor: Nigel Richard Wildman, North Harrow, England

[73] Assignee: Eastman Kodak Company, Rochester, N.Y.

[21] Appl. No.: 713,926

[22] Filed: Sep. 13, 1996

[30] Foreign Application Priority Data

Oct. 18, 1995 [GB] United Kingdom ..... 9521387

[51] Int. Cl.[6] ..... G03C 5/31; G03C 7/44

[52] U.S. Cl. ..... 430/399; 430/398; 430/434; 430/447; 430/489

[58] Field of Search ..... 430/398, 399, 430/434, 447, 489

[56] References Cited

U.S. PATENT DOCUMENTS

| | | | |
|---|---|---|---|
| 3,970,457 | 7/1976 | Parsonage | 430/30 |
| 4,010,034 | 3/1977 | Suga et al. | 430/399 |
| 4,025,344 | 5/1977 | Allen et al. | 430/265 |
| 4,186,007 | 1/1980 | Meckl et al. | 430/399 |
| 4,313,808 | 2/1982 | Idemoto et al. | 430/399 |
| 4,348,475 | 9/1982 | Wernicke et al. | 430/399 |
| 4,529,687 | 7/1985 | Hirai et al. | 430/373 |
| 4,680,123 | 7/1987 | Wernicke et al. | 430/399 |
| 4,719,173 | 1/1988 | Hahm | 430/398 |
| 4,786,584 | 11/1988 | Endo | 430/434 |
| 4,828,968 | 5/1989 | Okutsu | 430/398 |
| 4,977,067 | 12/1990 | Yoshikawa et al. | 430/398 |
| 5,355,191 | 10/1994 | Nakamura et al. | 354/324 |

FOREIGN PATENT DOCUMENTS

| | | |
|---|---|---|
| 2004893 | 8/1971 | Germany . |
| 2005566 | 4/1979 | United Kingdom . |
| WO 91/07698 | 5/1991 | WIPO . |
| WO 91/07699 | 5/1991 | WIPO . |

*Primary Examiner*—Hoa Van Le
*Attorney, Agent, or Firm*—Frank Pincelli

[57] ABSTRACT

A low volume developer tank system for the sequential processing of films that require different concentrations of bromide ions in the developer solution comprises a developer tank (2) provided with an ion exchange column (30) for removing bromide ions from solution which column can be engaged and disengaged and a plurality of reservoirs (6,8, 10,12,14) arranged to feed individual replenisher components to the recirculation system (20). When processing a process C-41 compatible film the system is preferably operated with no bromide in the replenisher and removal of bromide from the developer is by overflow. When processing a film employing zero or very low bromide, the system is preferably operated with no bromide in the replenisher, substantially no overflow and removal of bromide from the developer is by ion exchange.

6 Claims, 5 Drawing Sheets

Ca= conc of rep A
Cb= conc of rep B
Cc= conc of rep C
p= KBr or NaBr pellets
W= water
Ra= rep rate of A
Rb= rep rate of B
Rc= rep rate of C
Rw= rep rate of water
Ro= rate of overflow
Ri= rate of carryout
Ct= tank concentration
Ur= usage rate
Ol= oxidation loss Ca= 85 g/l
Cb= 7.77 g/l
Cc= 51 g/l Ra= 0.64 ml/m
Rb= 0.64 ml/m
Rc= 0.64 ml/m
Ri= 1.92 ml/m
Ur= 0.024 g/m
Ct= 4.5 g/l Ca= 0 g/l
Cb= 0 g/l
Cc= 0 g/l Ra= 4.1 ml/m
Rb= 4.1 ml/m
Rc= 1.55 ml/m
Rw= 2.55 ml/m
Rr= 12.3 ml/m
Ur= 0.016 g/m Ct= 1.3 g/l Ca= 85 g/l
Cb= 7.77 g/l
Cc= 51 g/l Ra= 4.1 ml/m
Rb= 4.1 ml/m
Rc= 1.55 ml/m
Rw= 2.55 ml/m
Rr= 12.3 ml/m
Ur= 0.024 g/m
Ct= 4.5 g/l
Rr= 12.3 ml/m

PROCESSING SYSTEM FOR THE DEVELOPMENT OF PHOTOGRAPHIC MATERIALS

FIELD OF THE INVENTION

This invention relates to the processing of photographic materials more particularly to the processing of silver halide color negative film and a developing system that can be adjusted to run under different process conditions.

BACKGROUND OF THE INVENTION

In the processing of exposed photographic materials the first step is usually the treatment of the exposed material with a developer to reduce the silver halide to metallic silver. In black and white photography the metallic silver usually comprises the desired image.

In color photography development it is necessary at an appropriate stage to remove the silver image, which if left behind, would darken the dye image. Also it is necessary to remove unused silver halide because it darkens on exposure to light.

In the development of photographic materials on a commercial scale the process is frequently carried out continuously. The developer processing solution is contained in a tank and it is necessary to make up the composition of the solution as it is used up by the addition of replenisher solution. However, the addition of replenisher solution causes processing solution to be displaced from the tank. The displaced solution is unsuitable to be returned to the tank containing the developer as replenisher without further treatment and its disposal may present environmental problems.

Color negative films are usually processed in an industry standard process called C-41. Most C-41 systems are run on the basis that a replenisher solution is added to the developer and excess developer is removed by letting it overflow. The developer solution thus achieves a stable condition in which chemicals used up during processing are replenished to maintain a working concentration and seasoning products, e.g., bromide and iodide ions and antifoggant fragments entering the developer solution from the film are kept to an acceptable level.

Previously the C-41 process has been operated at a replenishment rate of about 1600 ml/m$^2$ for Kodak VR400 35 mm film. In recent years the replenishment rate has been lowered to about 800 ml/m$^2$ in a process called the C-41 Low Replenishment Rate Process(LORR). This process uses a replenisher containing about 0.8 g/l of KBr. In a further development known as the Very Low Replenishment Rate process (VLORR) the replenishment rate is about a half that of the LORR process, there is no bromide in the replenisher and the bromide ion concentration is maintained at about 1.3 g/l in the developer tank by overflow from the tank. In a further development known as the Low Effluent Process (LOEFF) the replenishment rate is further reduced to about 50 to 120 ml/m$^2$ and there is no bromide in the replenisher. The replenishment is carried out with a sufficiently small volume of replenisher components that substantially no overflow is produced from the developer tank. The bromide concentration is maintained at about 1.3 g/l in the developer tank by passing the developer solution through an ion exchange column to remove excess bromide. This process is disclosed in European Patent No 500592 which describes the processing of photographic silver halide color negative film.

One of the main advantages of the process described in European Patent 500592 is the significant reduction in effluent.

Problem to be Solved by the Invention

Some photographic materials require a higher concentration of bromide ions in the developer solution than others and previously it has not been possible, after processing one type of photographic material, to switch to another type requiring a different bromide concentration in the same processing system and obtain fully satisfactory results. As a consequence the practice has been for each type of photographic material to be processed using its own processing system.

The present invention provides a solution to this problem by providing a processing system that is able to process different photographic materials which require different concentrations of bromide in the developing solution.

SUMMARY OF THE INVENTION

According to the present invention there is provided a low volume developer tank system capable of sequentially processing photographic materials that require different bromide concentrations in the developer solution, said tank system comprising a tank (2), hereafter referred to as a developer tank, the developer tank (2) being provided with means (20,30) for removing bromide ions from the developer solution in the tank (2) which means can be engaged and disengaged.

Advantageous Effect of the Invention

Use of the present invention enables both films which are compatible with either the current process C-41 or with zero or very low bromide developer concentrations to be processed in the same tank with a rapid changeover between film types.

DETAILED DESCRIPTION OF THE INVENTION

Figure 1:
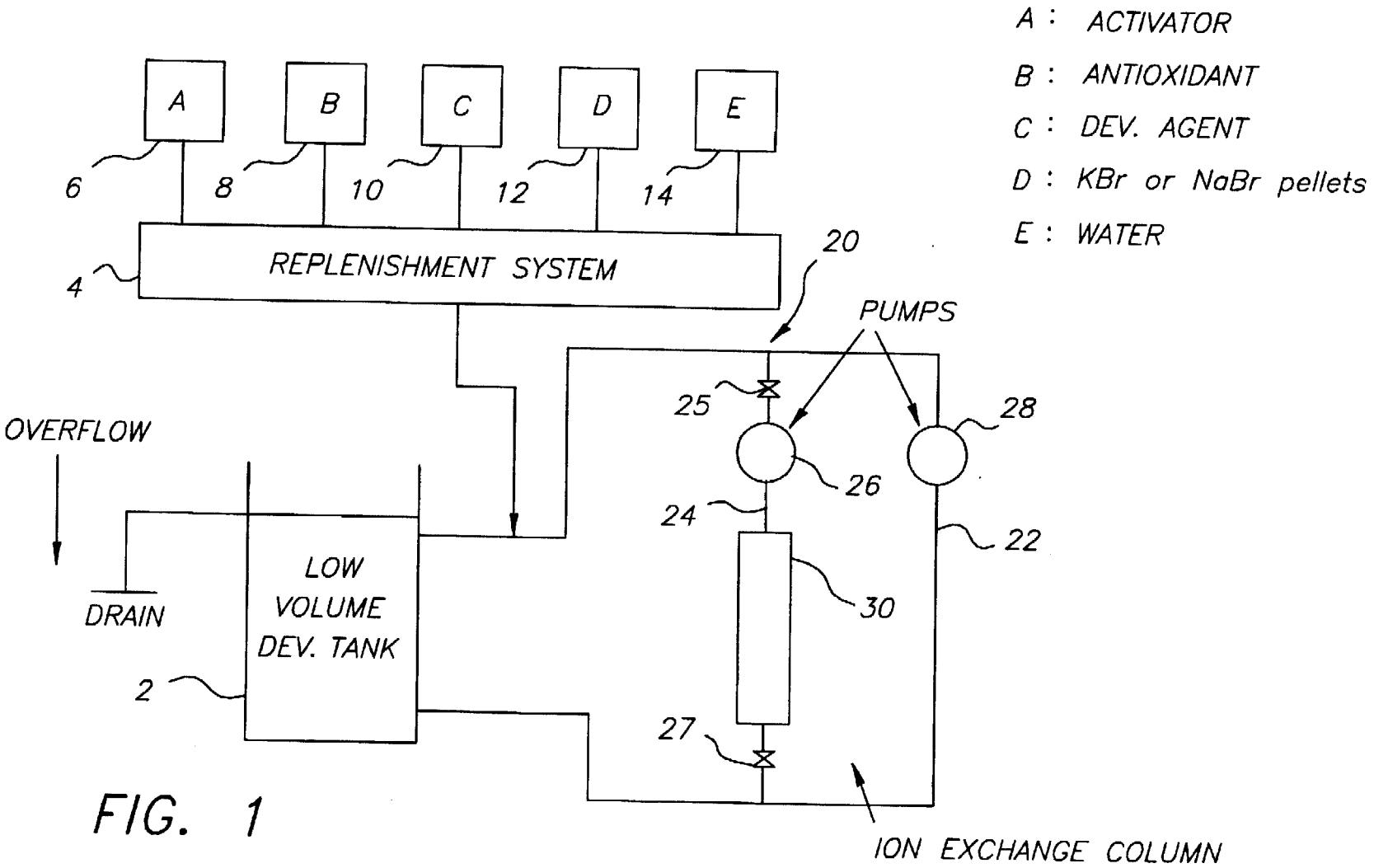
FIG. 1 is a schematic diagram of the developer tank and replenisher system for single tank universal development.

Preferably the means for removing the bromide ions comprises a recirculation system containing an ion exchange resin. Preferably the recirculation system can be engaged and disengaged by means of a pump or other suitable means such as valves which can be turned on and off, or opened and closed as desired.

The ion exchange resin may comprise anionic (for the exchange of anions) or amphoteric types or mixtures thereof. A preferred type of anionic resin is based on a polystyrene matrix crosslinked for example with 3% to 5% of divinyl benzene. Its strongly basic character is derived from quaternary ammonium groups. Examples of suitable anionic exchange resins are:

IRA 400 Rohm and Haas

Dowex 1-X8 Dow Chemical Company

Duolite A113 Diamond Shamrock

The ion exchange resin is preferably located in a cartridge through which the contents of the color developer tank are pumped either continuously or when required. When it has been exhausted it may be replaced or regenerated.

The developer tank is a low volume tank as this will facilitate rapid removal of the bromide by the anion exchange resin when it is desired to change to a film requiring a lower bromide concentration in the developer. It also means that for a given volume of anion exchange resin the life is longer. By low volume we mean the volume in the tank itself (i.e., not including any recirculation system) is less than 5 liters, more preferably less than 2.5 liters and may be about 1 liter.

Preferably a plurality of reservoirs are provided arranged to feed individual replenisher components to the recirculation system. There may be 3,4,5 or more reservoirs arranged to hold activator (or buffer), antioxidant, developing agent, bromide, usually in the form of pellets of the sodium or preferably the potassium salt, and water. Preferably means are provided for controlling the rates of addition of the individual components to the recirculation system.

According to another aspect of the present invention there is provided a process for the sequential development in the same development tank of photographic materials requiring different concentrations of bromide in the developer solution, which process comprises the steps in any order;

providing the developer tank with developer solution having the required concentration of bromide for the photographic material that requires the higher concentration of bromide (the first material) and developing the first photographic material therein and, when it is desired to process the photographic material requiring the lower or zero concentration of bromide (the second material), discontinuing the processing of the first material and treating the solution in the development tank to remove bromide to the required lower or zero concentration and processing the second material therein.

If after the second step it is desired to process a photographic material requiring a higher concentration of bromide which may be the first photographic material or another material (a third photographic material), the processing of the second material is discontinued and bromide added to the developer solution to bring the concentration, to the required higher concentration.

When processing the photographic material employing the higher bromide concentration, the process is preferably operated with no bromide in the replenisher and removal of bromide from the developer solution is by overflow from the developer tank, more preferably with the concentration of bromide and replenishment rates of the Very Low Replenishment Rate (VLORR) process.

When processing the photographic material employing the lower or zero bromide concentration, the process is preferably operated with no bromide in the replenisher, substantially no overflow and with removal of bromide from the developer by means of ion exchange, more preferably with the replenishment rates of the Low Effluent Process (LOEFF). When operated in this way there is no loss of color developer except by carryout and oxidation.

The process of the invention has particular application when the volume of the developer solution is relatively low, for example, below 5 liters and particularly below 2.5 liters and may be about 1 liter. The material to be processed is conveniently passed through the tank and preferably the developer solution is recirculated through the tank at a rate of 0.1 to 10 tank volumes per minute. The preferred recirculation rate is from 0.5 to 8 especially from 1 to 5 and particularly from 2 to 4 tank volumes per minute.

The recirculation with or without replenishment may be carried out continuously or intermittently. In one method of working both can be carried out continuously while processing is in progress whereby the bromide ion concentration may be maintained at the required level by continuously removing bromide ions from the developer solution. The recirculation may be carried out not at all, intermittently or continuously when the tank is idle.

Replenishment may be carried out by introducing the required amount of replenisher into the recirculation system either inside or preferably outside the processing tank.

As stated above, it is advantageous to use a tank of relatively small volume. Hence in a preferred embodiment of the present invention the ratio of the tank volume to the maximum area of material that can be accommodated therein (i.e., maximum path length times width of material) is less than 11 $dm^3/m^2$, preferably less than 3 $dm^3/m^2$.

The shape and dimensions of the processing tank are preferably such that it holds the minimum amount of processing solution while still obtaining the required results. The tank is preferably one with fixed sides, the material being advanced therethrough by drive rollers. Preferably the photographic material passes through a thickness of solution of less than 11 mm, preferably less than 5 mm and especially about 2 mm.

The shape of the tank is not critical but it may conveniently be in the shape of a shallow tray or, preferably U-shaped.

It is preferred that the dimensions of the tank be chosen so that the width of the tank is the same as or only just wider than the width of the material being processed.

The total volume of the processing solution within the developer tank and recirculation system is relatively smaller as compared with prior art processes. In particular the total amount of processing solution in the entire processing system for a particular module is such that the total volume in the tank is at least 40% of the total volume of the processing solution in the entire system. Preferably the volume of the tank is at least about 50% of the total volume of the processing solution in the system.

In order to provide efficient agitation and flow of the processing solution into the tank, it is desirable to have openings or nozzles in the tank wall(s) having a configuration in accordance with the following relationship:

$$0.6>F/A<23$$

where F is the flow rate of the solution through the nozzle in l/min, and

A is the cross-sectional area of the nozzle provided in $cm^2$.

Providing a nozzle in accordance with the foregoing relationship assures appropriate discharge of the processing solution against the photosensitive material.

Such low volume thin tank systems are described in more detail in the following patent specifications:

U.S. Pat. No. 5,294,956; U.S. Pat. No. 5,179,404; U.S. Pat. No. 5,270,762; EP 559,025; EP 559,026; EP 559,027; WO92/10790; WO92/17819; WO93/04404; WO92/17370; WO91/19226; WO91/12567; WO92/07302; WO93/00612; and WO92/07301.

The developer tank and replenisher system of the invention could be combined into a processing machine for films comprising a magnetic recording layer to enable films compatible with zero or very low bromide developers to be introduced commercially.

The tank and replenisher system, when operated in zero or very low bromide mode and combined with silver chloride color negative films, as described in EP-A 0 617 325, offers advantages in development rate which can be translated into reductions in development time, thereby allowing faster processing.

In a typical C-41 process for developing color negative film the film is exposed to a test step wedge and processed by the following steps at 37.8° C.

| | |
|---|---|
| 1. color developer | 3.25 mins |
| 2. bleach | 4.35 mins |
| 3. wash | 1.00 mins |
| 4. fix | 4.35 mins |
| 5. stabilizer | 1.00 mins |
| color developer | |
| sodium hexametaphosphate | 2.00 g |
| potassium carbonate | 28.6 g |
| sodium sulphite (anhydrous) | 4.25 g |
| potassium bromide | 1.3 g |
| hydroxylamine sulphate | 2.59 g |
| 4-(N-ethyl-N-2-hydroxyethyl)-2-methylphenylenediamine sulphate (CD4) | 4.5 g |
| water to | 1.0 liter |
| pH = 10.1 | |
| bleach | |
| sodium iron (III) ethylenediamine-tetraacetic acid | 100.0 g |
| potassium bromide | 50.0 g |
| ammonia (20%) | 6.0 g |
| water to | 1.0 liter |
| fixer | |
| ammonium thiosulphate | 120.0 g |
| sodium sulphite (anhydrous) | 20.0 g |
| potassium metabisulphite | 20.0 g |
| water to | 1.0 liter |
| stabilizer | |
| wetting agent (10% solution) | 10.0 ml |
| formaldehyde (36% solution) | 6.0 ml |
| water to | 1.0 liter. |

The processing system is illustrated in FIG. 1 and comprises a low volume development tank 2 containing developer solution and a replenishment system indicated generally by numeral 4. The replenishment system is provided with five reservoirs 6,8,10,12 and 14 for respectively, activator, antioxidant, developing agent, potassium or sodium bromide pellets and water. The activator, antioxidant and developing agent are conveniently provided in the form of concentrated solutions. The reservoirs are provided with means (not shown) for individually varying and controlling the addition of the five replenisher components to the recirculation system.

The developer tank 2 is provided with means for removing bromide from the developer solution in the form of a recirculation system 20 which comprises pipes 22 and 24, pumps 26 and 28 and a column of anion exchange resin 30. Valves 25 and 27 can be closed so that flow is through line 22 only. With valves 25 and 27 open flow is through lines 22 and 24 and column 30.

The invention is illustrated by the following Example which shows the processing system of the invention operated in two different modes, one mode with a process C-41 compatible film and the other with a zero or very low bromide compatible film and gives details of the effluents produced in each of the two modes of operation.

In the first mode of operation when conventional C-41 films are processed, the C-41 developer is replenished by concentrates A(6),B(8),C(10) and water 14. In this mode the ion exchange column 30 would not be in use, e.g., the pump 26 that feeds it is switched off and valves 25,27 are closed. The replenishment is then adjusted so that the lowest possible replenishment rate is used (approximately half the C-41 LORR replenishment rate) which will keep the bromide ion concentration at 1.3 g/l (the C-41 aim) by overflowing developer tank solution. Therefore some color developing agent is overflowed but at half the current rate for C-41 LORR for conventional films.

In the second mode of operation the film which is developed is one designed to produce the correct sensitometry in a C-41 developer which does not contain any development-restraining bromide ions. Firstly the developer is pumped through the ion exchange column 30. This removes the bromide ions from the developer and as the developer volume is small the removal time will not be significant. The film is then processed under a different set of replenishment conditions. As bromide does not need to be removed by overflowing developer at a set rate, then the replenishment rate and volume can be reduced to only account for usage by the film and carryout from the tank. The only volume loss is by carryout. All the bromide ions released from the film are removed by the ion exchange column 30. There is no overflow from the tank and therefore no color developing agent is wasted.

If it is then desired to switch to processing a C-41 compatible film, the pump 26 that feeds the ion exchange column 30 is turned off and valves 25,27 closed and the tank is replenished with a pellet of potassium or sodium bromide 12 which returns the bromide concentration to 1.3 g/l and the film can now be processed.

Figure 2:
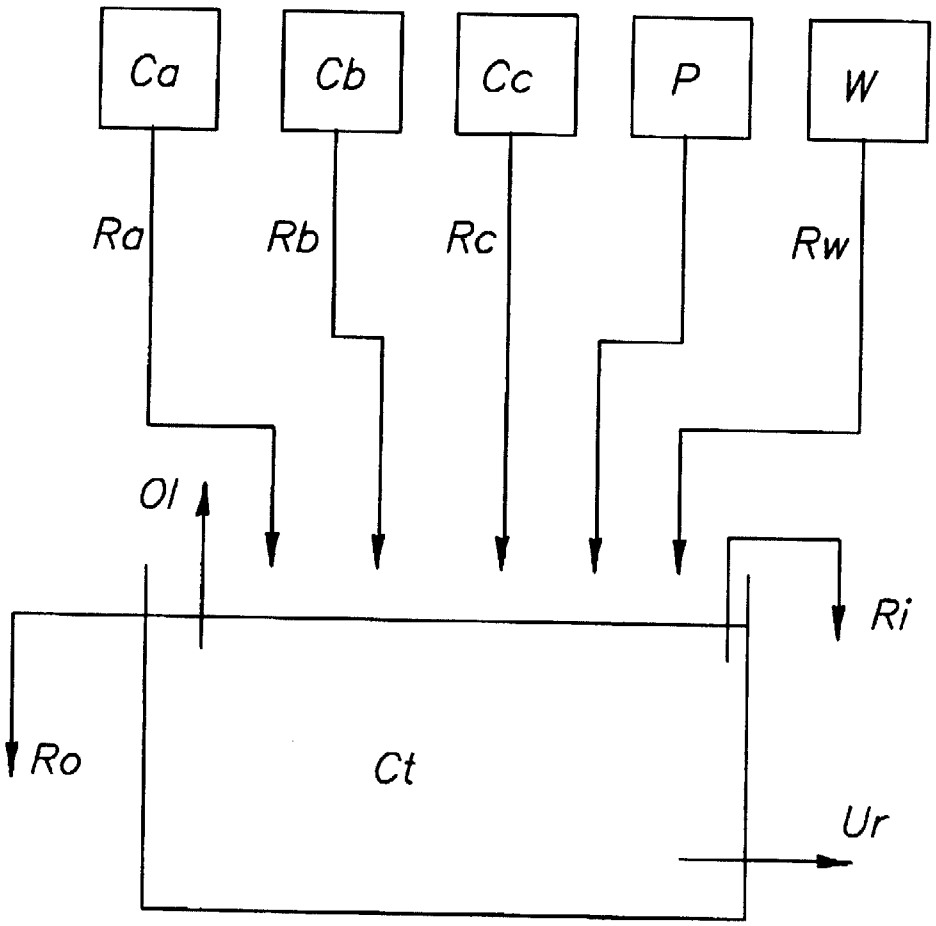
FIG. 2 is a schematic diagram of the developer tank system with an explanation of the terms used in the mass balance calculations.

Referring to FIG. 2, for a single replenisher component of concentration Cr replenished at rate Rr then, $$Cr.Rr=Ur+Ct.Ro+Ct.\ Ri+O1$$

where:

Ur is the usage rate of replenished component;

Ct is the concentration of component in the tank;

Ro is the rate of overflow of component to drain;

Ri is the rate off carryout of component from the tank; and

O1 is the loss of component by aerial oxidation.

Assuming that the oxidation loss O1 is negligible for ease of calculation and that the evaporation is insignificant then, Cr.Rr=Ur+Ct.Ro+Ct.Ri which can be simplified to:

Cr.Rr=Ur+Ct.Rr as volume in=volume overflowed+carryout

So, for the A replenisher, for example, Ca.Ra=Ur+Ct.Ra

Replenishment rates are usually quoted in terms of ml or 1 of solution/$m^2$ or alternatively in ml or l/m in the case of a 35 mm film.

In the following example the rates will be quoted in ml/m of 35 mm film.

For VR 100 film (which is a C41 compatible film):

Carryout is 1.92 ml/m=Ri

CD4 usage is 0.024 g/m

Bromide released by film is 0.016 g/m

Figure 3:
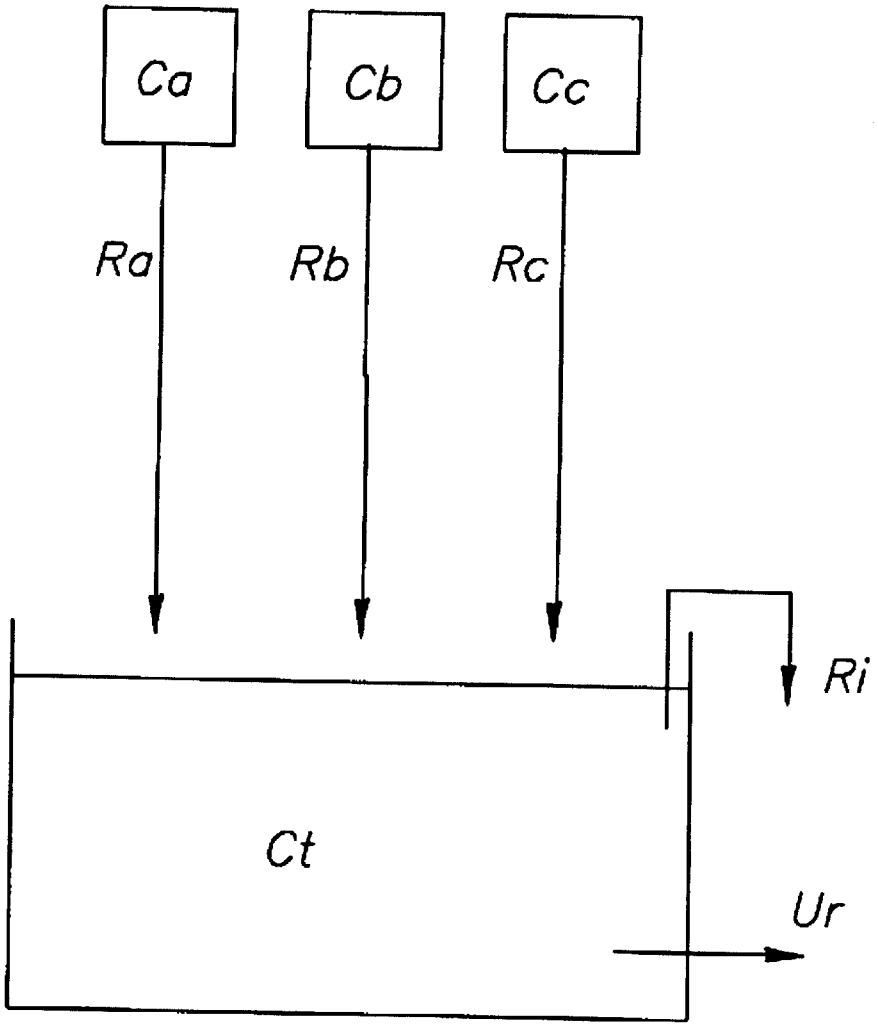
FIG. 3 is a representation of the mass balance for CD4 in a LOEFF process.
Figure 4:
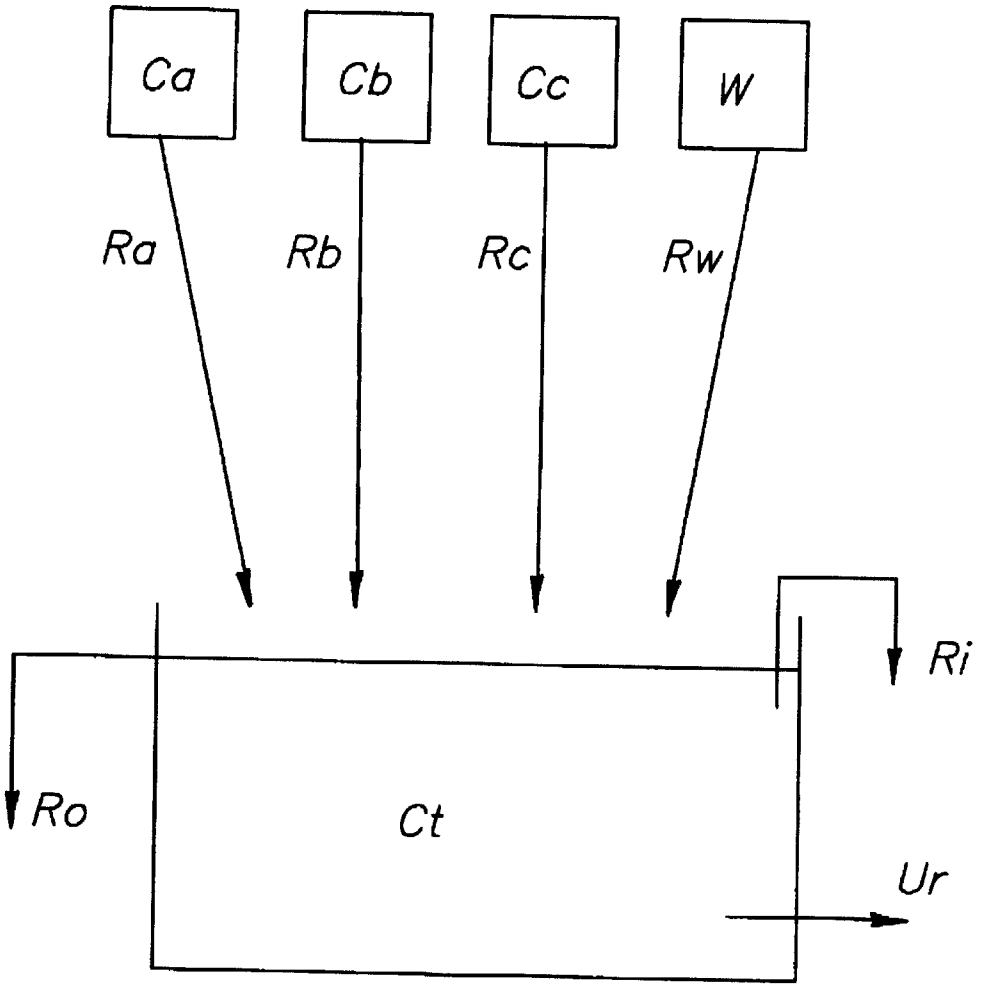
FIG. 4 is a representation of the mass balance for bromide in a VLORR process.
Figure 5:
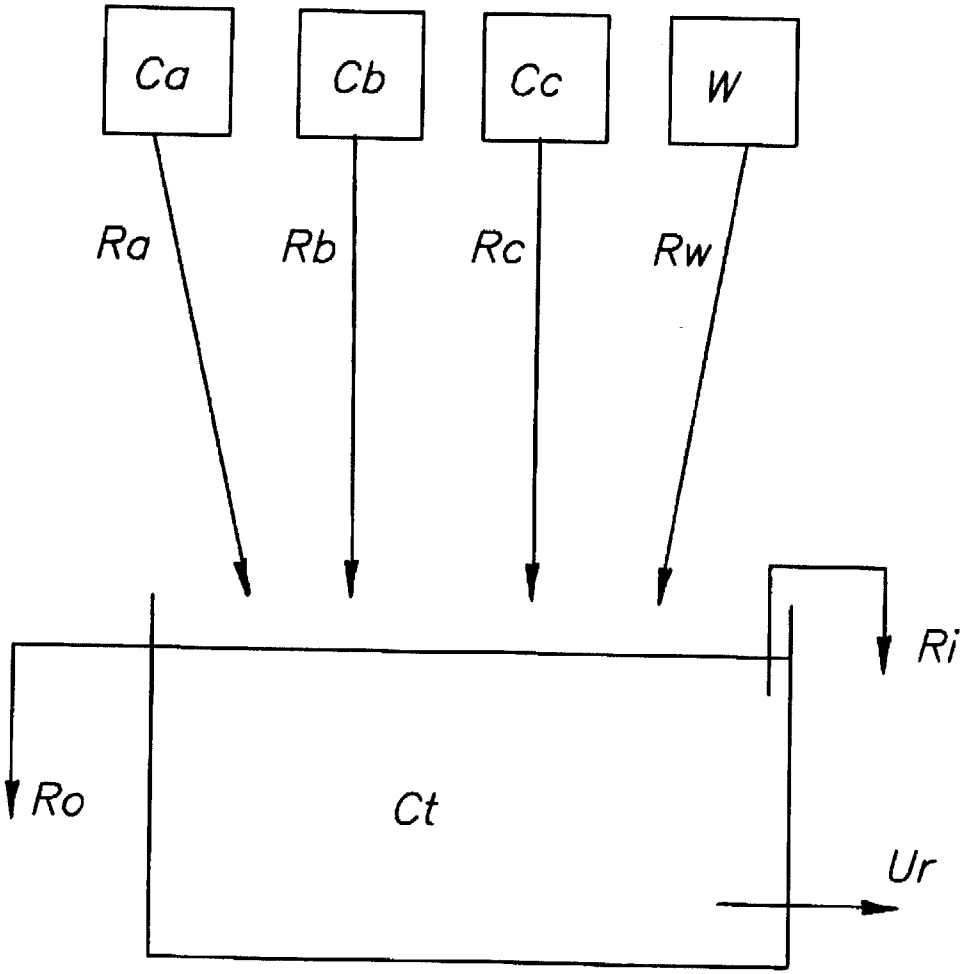
FIG. 5 is a representation of the mass balance for CD4 in a VLORR process.

Taking the case of LOEFF, i.e., scenario 2 in the above description, the only losses from the system are from usage and carryout. Referring to FIG. 3

As volume in=volume out $$Ra+Rb+Rc=Ri=1.92\ ml/m$$

Therefore, each of the three parts is replenished with 0.64 ml/m.

Therefore the concentration of replenishers is given by:

Activator:

$$Ca = \frac{Ur + (Ct.Ri)}{Ra} = \frac{0 + (28.6 \times 1.92 \times 10^{-3})}{0.64 \times 10^{-3}} = 85\ g/l$$

where Ct is the aim concentration of potassium carbonate

Antioxidant:

$$Cb = \frac{0 + (2.59 \times 1.92 \times 10^{-3})}{0.64 \times 10^{-3}} = 7.77\ g/l$$

where Ct is the aim concentration of hydroxylamine sulphate

CD4:

$$Cc = \frac{0.024 + (4.5 \times 1.92 \times 10^{-3})}{0.64 \times 10^{-3}} = 51\ g/l$$

where Ct is the aim concentration of color developing agent (CD4)

Knowing these replenisher concentrations then the replenisher rates for the VLORR scenario can be individually calculated knowing that the overall replenishment rate, Rr, must equal 12.3 ml/m to provide adequate bromide removal. This is calculated from the bromide release rate of 0.016 g/m divided by the aim concentration of bromide ions of 1.3 g/l.

$$Ra = \frac{Ur + (Ct.Rr)}{Ca} = \frac{0 + (28.6 \times 12.3)}{85}$$

Ra=4.1 ml/m $$Rb = \frac{Ur + (Ct.Rr)}{Cb} = \frac{(0 + 2.59 \times 12.3)}{7.77}$$

Rb=4.1 ml/m $$\text{e.g., } Rc = \frac{Ur + (Ct.Rr)}{Cc} = \frac{0.024 + (4.5 \times 12.3)}{51}$$

Rc=1.55 ml/m.

Therefore,

Ra+Rb+Rc=9.75 ml/m

Aim replenishment rate for VLORR=12.3 ml/m

Difference=12.3−9.75=2.55 ml/m

This is added as water to control the seasoned bromide concentration to 1.3 g/l

This shows that the VLORR and LOEFF processes can be carried out in the same tank with concentrated replenisher solutions by varying the replenisher rate and adding water if required.

Comparing these processes in terms of color developer (CD4) to drain, then the concentration of CD4 is given by Ct(Ro+Ri) or Ct. Rr.

In LORR process Ct.Rr=4.5 g/l×0.0375 l/m=0.168 g/m where Rr is is the quoted C.41 LORR replenishment rate In VLORR process Ct.Rr=4.5 g/l×0.0123 l/m=0.055 g/m In LOEFF process Ct.Rr=4.5 g/l×0.00192 l/m=0.00864 g/m Both processes provide a clear advantage over the conventional C-41 LORR process and the LOEFF process provides a very significant reduction in the amount of color developer (CD4) to drain.

Parts List

2 . . . development tank
4 . . . replenishment system
6,8,10,12,14 . . . reservoirs
20 . . . recirculation system
22,24 . . . pipes
25,27 . . . valves
26,28 . . . pumps
30 . . . anion exchange resin column

I claim:

1. A process for the sequential development in the same development tank of photographic materials requiring different concentrations of bromide in the developer solution, which process comprises the steps in any order;

providing the developer tank with developer solution having the required concentration of bromide for a first photographic material that requires a first concentration of bromide and developing the first photographic material therein and, when it is desired to process a second photographic material requiring a lower or zero concentration of bromide, discontinuing the processing of the first material and treating the solution in the development tank to remove bromide to the required lower or zero concentration and processing the second material therein.

2. A process as claimed in claim 1 wherein the solution in the development tank is treated continuously to maintain the bromide ion concentration at the required concentration.

3. A process as claimed in claim 1 wherein when, after the second step, there is processed a third photographic material requiring a third bromide concentration higher than the previous concentration, the processing of the previous material is discontinued and bromide added to the developer solution to bring the concentration to the third bromide concentration.

4. A process as claimed in claim 1 which comprises carrying out the process in a tank wherein the ratio of the tank volume to the maximum area of material that can be accommodated therein is less than 11 $dm^3/m^2$ preferably less than 3 $dm^3/m^2$.

5. A process as claimed in claim 1 wherein the processing of the photographic material employing the higher bromide concentration is carried out with no bromide in the replenisher and removal of bromide from the developer solution by overflow from the developer tank, preferably with the concentration of bromide and replenishment rates of the Very Low Replenishment Rate (VLORR) process.

6. A process as claimed in claim 1 wherein the processing of the photographic material employing the lower or zero bromide concentration, is carried out with no bromide in the replenisher, substantially no overflow and with removal of bromide from the developer by means of ion exchange, preferably with the replenishment rates of the Low Effluent Process (LOEFF).

* * * * *